US009657933B2

(12) United States Patent
Clark

(10) Patent No.: US 9,657,933 B2
(45) Date of Patent: May 23, 2017

(54) INTERLACED HEAT SINK FOR RECESSED LIGHT

(71) Applicant: ABL IP Holding LLC, Decatur, GA (US)

(72) Inventor: Stephen Howard Clark, Downers Grove, IL (US)

(73) Assignee: ABL IP Holding LLC, Decatur, GA (US)

( * ) Notice: Subject to any disclaimer, the term of this patent is extended or adjusted under 35 U.S.C. 154(b) by 32 days.

(21) Appl. No.: 14/606,654

(22) Filed: Jan. 27, 2015

(65) Prior Publication Data

US 2015/0219331 A1 Aug. 6, 2015

Related U.S. Application Data

(60) Provisional application No. 61/934,955, filed on Feb. 3, 2014.

(51) Int. Cl.
*F21V 29/76* (2015.01)
*F21S 8/02* (2006.01)
(Continued)

(52) U.S. Cl.
CPC ..... *F21V 29/763* (2015.01); *F21S 8/026* (2013.01); *F21V 14/02* (2013.01); *F21V 19/02* (2013.01);
(Continued)

(58) Field of Classification Search
CPC ..... F21V 29/754; F21V 29/75; F21V 29/763; F21V 29/76; F21V 29/713; F21V 29/74;
(Continued)

(56) References Cited

U.S. PATENT DOCUMENTS 8,348,452 B2 * 1/2013 Zheng ..... F21S 9/03 362/184
8,403,533 B1 * 3/2013 Paulsel ..... F21S 8/026 362/249.02
(Continued)

FOREIGN PATENT DOCUMENTS

EP 1906078 A1 4/2008

OTHER PUBLICATIONS

Office Action for Mexican Application No. MX/A/2015/001421 (2 pages English Translation; 2 pages for MX OA), mailed Nov. 14, 2016, 4 pages.

*Primary Examiner* — Robert May
(74) *Attorney, Agent, or Firm* — Kilpatrick, Townsend & Stockton, LLP

(57) ABSTRACT

A recessed light fixture can include a movably adjustable light source and a thermal management system that includes a movable first heat sink, and a second heat sink. The first heat sink is thermally coupled to the adjustable light source, and is connected to move with the adjustable light source. The first heat sink includes a plurality of spaced apart first thermally conductive elements, such as fins. The second heat sink includes a plurality of spaced apart second thermally conductive elements, such as fins, which are interlaced between the first thermally conductive elements of the first heat sink. The interlaced thermally conductive elements increase surface area and heat transfer pathway(s) between the two heat sinks, while reducing physical contact, and thus friction, therebetween when movably adjusting the light source.

21 Claims, 8 Drawing Sheets

(51) Int. Cl.

| | |
|---|---|
| ***F21V 19/02*** | (2006.01) |
| ***F21V 14/02*** | (2006.01) |
| ***F21V 21/30*** | (2006.01) |
| ***F21V 29/71*** | (2015.01) |
| *F21V 29/83* | (2015.01) |
| *F21Y 101/00* | (2016.01) |

(52) U.S. Cl.
CPC ..... *F21V 21/30* (2013.01); *F21V 29/71* (2015.01); *F21V 29/83* (2015.01); *F21Y 2101/00* (2013.01)

(58) Field of Classification Search
CPC ..... F21V 29/767; F21V 29/77; F21V 29/773; F21V 29/777; F21V 29/78; F21V 29/71; F21V 29/2212; F21S 8/026
See application file for complete search history.

(56) References Cited

U.S. PATENT DOCUMENTS

2006/0250788 A1* 11/2006 Hodge ..... F21S 8/02 362/147
2012/0293952 A1* 11/2012 Herring ..... H01L 23/367 361/679.54
2014/0063823 A1* 3/2014 Miwa ..... F21V 19/004 362/396
2016/0356483 A1* 12/2016 Gebhard ..... F21V 29/02

* cited by examiner

INTERLACED HEAT SINK FOR RECESSED LIGHT

RELATED CASES

The present application claims priority under 35 U.S.C. §119(e) based on U.S. Provisional Application Ser. No. 61/934,955 filed on Feb. 3, 2014, which is incorporated by reference herein in its entirety.

FIELD

The present disclosure is related to a thermal management system for a recessed light fixture, which employs interlaced heat sinks.

BACKGROUND

A recessed light fixture is mountable onto a ceiling in a ceiling opening (e.g., a cut out), and can include a movably adjustable light source, such as incandescent or fluorescent lights or LEDs, which generate a significant amount of heat during operation. To maintain proper operating temperature and prevent overheating, the light fixture can incorporate a thermal management system, such as a heat sink system. For an LED fixture, the LED is mounted to a heat dissipating device, often an aluminum piece that functions as a heat sink. This mounting typically employs screws or a connector to hold the LED in position. In some other types of recessed light fixtures, the heat sink is firmly mounted to other components to transfer heat via conduction to the rest of the light fixture and finally to the surrounding environment. The use of a direct firm connection between the primary LED heat sink and the rest of the thermal management system is not ideal in applications for a movable light. Generally speaking, every part of the fixture can be considered part of the thermal management system in a recessed light fixture.

SUMMARY

To address these and other shortcomings, an improved thermal management system is provided for a recessed light fixture with a movably adjustable light source. The thermal management system includes two heat sinks, such as a movable first heat sink and a stationary second heat sink. The first heat sink is thermally coupled to the light source, and is connected to move with the light source. Each of the first and second heat sinks includes thermally conductive surface, which is arranged in proximity to the other. The thermally conductive surfaces of the two heat sinks include spaced apart thermally conductive elements, such as fins or pins, which are interlaced with one another to allow heat transfer primarily across a small air gap(s) from the first heat sink to the second heat sink via conduction (although some heat transfer may also occur through conduction and radiation). By having a small air gap, the light source of the recessed light fixture is movable while minimizing the distance that heat has to travel through air (particularly stagnant air). The interlaced thermally conductive elements increase a surface area on each of the heat sinks, and thus the cross sectional area that the heat travels through the air, to improve heat transfer therebetween primarily across minimal air gap(s). The use of interlaced thermally conductive elements also reduces or eliminates physical contact, and thus friction, between the two heat sinks, while allowing movement of the first heat sink relative to the second heat sink when movably adjusting the light source to different positions, such as angular, vertical or horizontal positions. Accordingly, the adjustability of the light source in the recessed light fixture is not significantly impacted or limited by the thermal management system.

The thermal management system of the present disclosure can be employed with different types of adjustable light sources, such as light sources that are rotatably adjustable (e.g., angular or arc-like movement) or linearly adjustable (e.g., in vertical or horizontal movement). For example, with a rotatably adjustable light source, the thermal management system can have the thermally conductive elements of the first or second heat sinks configured with an arc shape to allow the first heat sink to pass in very close proximity to the second heat sink as the light direction of the light source is rotatably adjusted. By designing the thermally conductive elements of the first heat sink to pass in close proximity to the second thermally conductive elements of the second heat sink, the thermally conductive path through air, e.g., air gap(s), is reduced between the two heat sinks thereby improving heat transfer between the interlaced thermally conductive elements of the two heat sinks.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

The present disclosure is directed to a recessed light fixture with an adjustable light source and a thermal management system that incorporates two interlaced heat sinks. The thermal management system includes a movable first heat sink thermally and physically coupled to the adjustable light source (e.g., LED, fluorescent or incandescent light), and a stationary second heat sink. The first and second heat sinks both have spaced apart thermally conductive elements, such as fins or pins, which are interlaced with each other to allow movement of the first heat sink relative to the second heat sink, without substantially impacting heat transfer primarily across air gap(s) between adjacent thermally conductive elements of the first and second heat sinks as they are adjusted. The interlaced thermally conductive elements of the first and second heat sinks also do not substantially hinder the adjustability of the light source. Examples of a recessed light fixture with dual interlaced heat sinks are described in greater detail below with reference to the figures.

Figure 1:
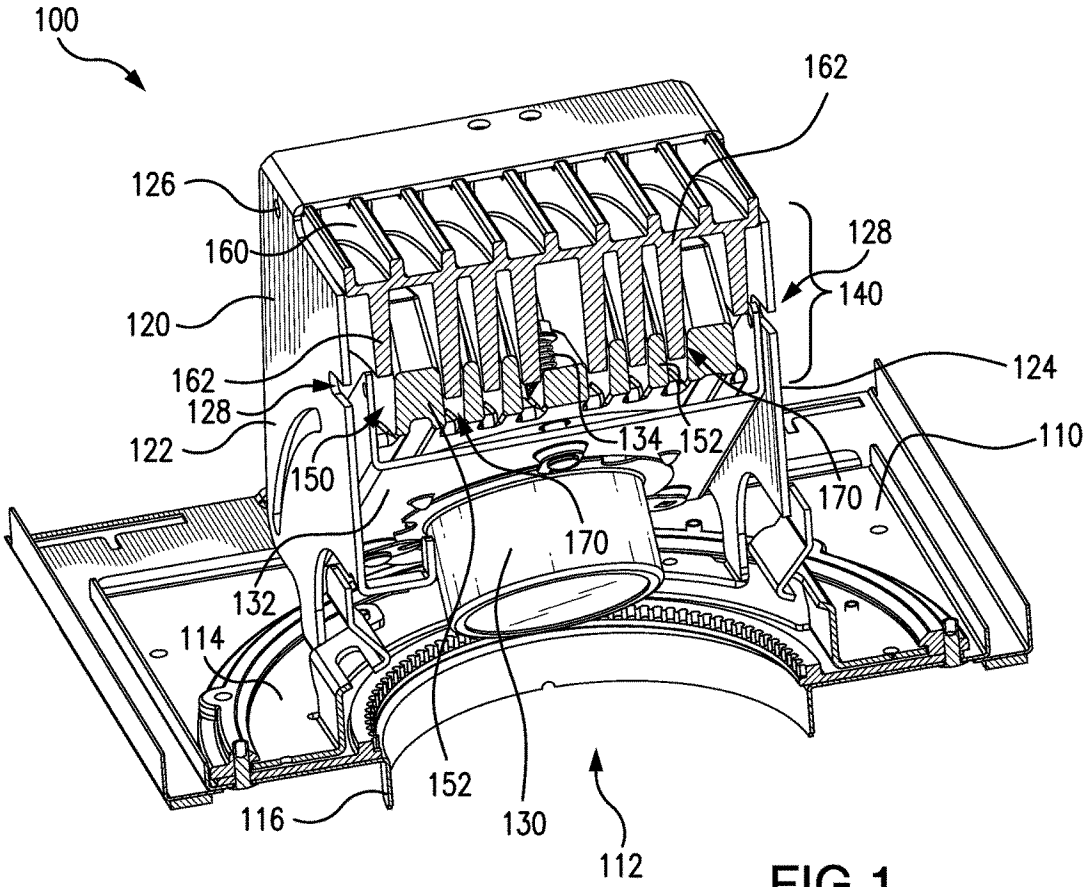
FIG. 1 illustrates a partial perspective view of a portion of a recessed light fixture with a rotatably adjustable light source and dual interlaced heat sinks, including a movable first heat sink and a stationary second heat sink, which are all connected to a mounting frame, in accordance with an exemplary first embodiment of the present disclosure.
Figure 2:
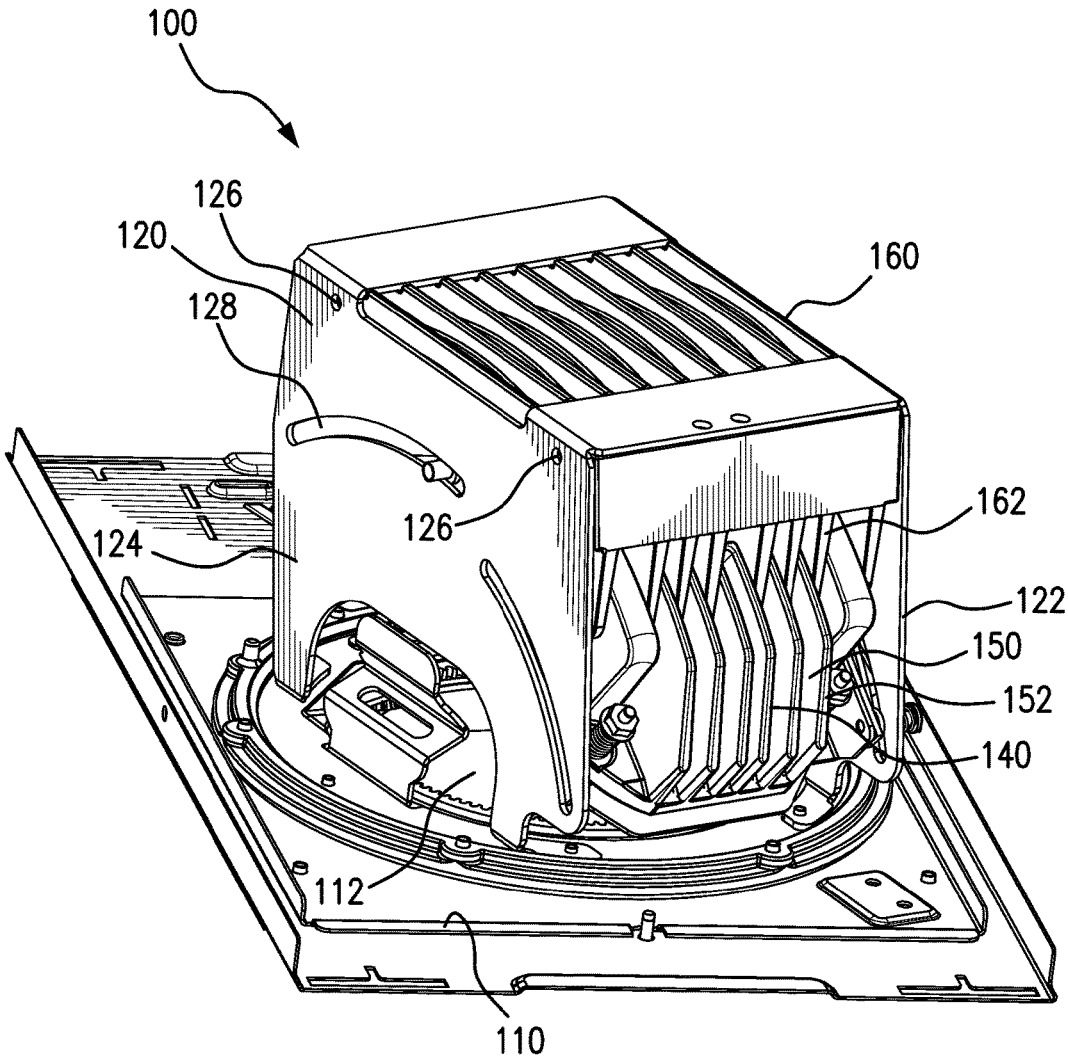
FIG. 2 illustrates another perspective view of the recessed light fixture of FIG. 1, which is secured onto a wall over a wall opening.

FIGS. 1 and 2 illustrate a portion of a recessed light fixture 100, in accordance with a first embodiment of the present disclosure. The recessed light fixture 100 includes a mounting frame 110, a support frame 120, a rotatably adjustable light source 130, and a thermal management system 140 for transferring heat away from the light source 130, and can include other components. The mounting frame 110 includes a mounting opening 112 and a rotatable ring 114 around the mounting opening 112. The support frame 120 includes a first support frame wall 122 and a second support frame wall 124. The first and second support frame walls 122 and 124 are connected to the rotatable ring 114 on opposite sides of the mounting opening 112, with the light source 130 movably connected between the first and second support frame walls 122 and 124 to emit light at adjustable angular positions through the mounting opening 112. For example, the light source 130 can include a platform 132 which is connected to slide along corresponding arc-shaped slots 128 on each of the first and second support frame walls 122 and 124 to allow the light source to be rotatably adjusted to different angular positions around a rotational axis (e.g., a center line of the rotation axis is at the center point of the arc, which is roughly at the center of the opening 112). For example, opposing sides of the platform 132 can be connected to slide on a respective one of the first and second support frame walls 122 and 124, using for example a bolt (not shown) that is connected to a respective side of the platform 132 through an adjacent slot 128.

The thermal management system 140 includes a movable first heat sink 150 and a stationary second heat sink 160. The first and second heat sinks 150 and 160 can be directly or indirectly connected to the support frame 120 between the first and second support frame walls 122 and 124. In this example, the first heat sink 150 is thermally and physically coupled to the light source 130, and can move along with the light source 130 between the first and second support frame walls 122 and 124. The first heat sink 150 is connected to the platform 132 of the light source 130 by a fastener 134 (e.g., a threaded bolt). The first heat sink 150 includes a plurality of spaced apart first thermally conductive elements 152. In this example, the first thermally conductive elements 152 are fins, which extend outward in a direction away from the platform 132.

The second heat sink 160 is fixedly connected to the support frame 120, between the first and second support frame walls 122 and 124. The second heat sink 160 includes a plurality of spaced apart second thermally conductive elements 162. In this example, the second thermally conductive elements 162 are fins. The first thermally conductive elements 152 of the first heat sink 150 are interlaced with the second thermally conductive elements 162 of the second heat sink 160, or vice-a-versa. The first heat sink 150 moves in relation to the second heat sink 160, when rotatably adjusting the light source. Accordingly, the first thermally conductive elements 152 define a first thermally conductive surface and the second thermally conductive elements 162 define a second thermally conductive surface. The first thermally conductive surface of the first heat sink 150 transfers heat to proximate portions of the second thermally conductive surface of the second heat 160 sink across an air gap, during operation of the light source 130.

The interlaced first and second thermally conductive elements 152 and 162 have air gap(s) 170 therebetween, which provide the primary heat transfer medium between the first and second heat sinks 150 and 160. The size and shape of the first and second thermally conductive elements 152 and 162 can, however, be configured to reduce and minimize the size of the air gap(s) 170 and increase surface area between adjacent first and second thermally conductive elements 152 and 162 to improve heat transfer, while reducing, minimizing or eliminating physical contact and thus friction therebetween when adjusting the position of the light source. For example, as shown, the first thermally conductive elements 152 and second thermally conductive elements 162 can have an arc shape, best seen in FIGS. 3 and 4, to reduce a size of an air gap between the interlaced first and second thermally conductive elements to allow the first heat sink 150 to pass in very close proximity to the second heat sink 160 as the light direction of the light source is rotatably adjusted.

Figure 3:
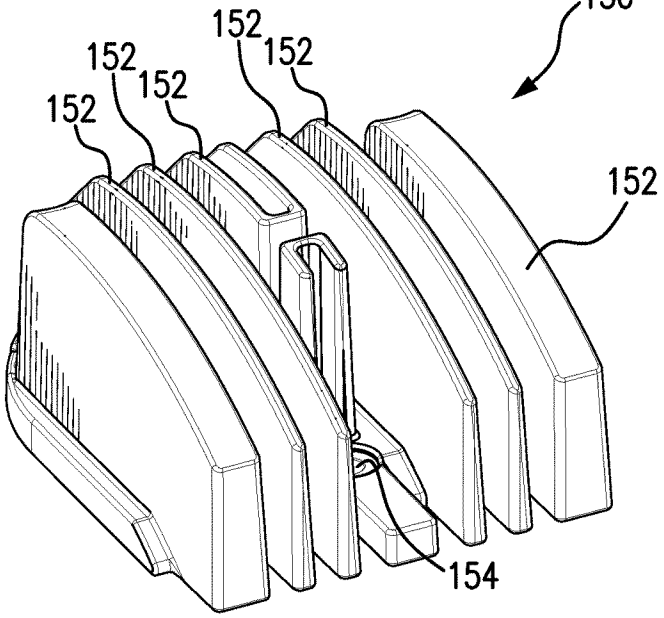
FIG. 3 illustrates the movable first heat sink of FIG. 1 with a plurality of spaced apart first thermally conductive elements in the form of fins, in accordance with an embodiment of the present disclosure.

FIG. 3 provides a view of only the first heat sink 150. As further shown in FIG. 3, the first heat sink 150 also includes a fastener hole 154 for receiving a fastener, such as the fastener 134 in FIG. 1, to connect the heat sink 150 to the platform 132 of the light source. The spaced apart first thermally conductive elements 152 have an arc shape, e.g., a convex shape.

Figure 4:
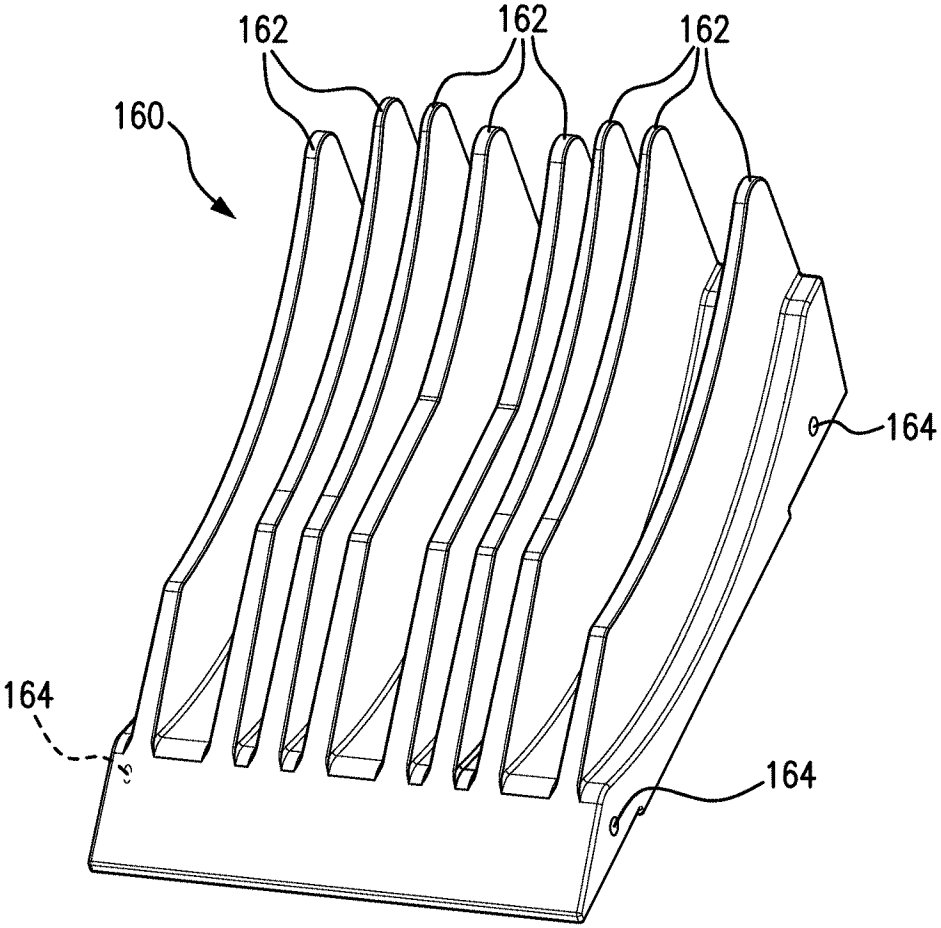
FIG. 4 illustrates the stationary second heat sink of FIG. 1 with a plurality of spaced apart second thermally conductive elements in the form of fins, in accordance with an embodiment of the present disclosure.

FIG. 4 provides a view of only the second heat sink 160. As further shown in FIG. 4, the second heat sink 160 also includes a plurality of holes 164. The holes 164 are configured to align with respective holes 126 (e.g., which are shown in FIG. 2) on the first and second frame support walls 122 and 124 to connect the second heat sink 160 to the support frame 120 between the first and second support walls 122 and 124 with fasteners such as a screw or bolt (not shown in FIG. 4 but shown for example in FIGS. 5-6). The spaced apart second thermally conductive elements 162 also have an arc shape, e.g., a concave shape. Furthermore, two or more of the second thermally conductive elements 162 can have substantially the same shape and dimension.

Figure 6:
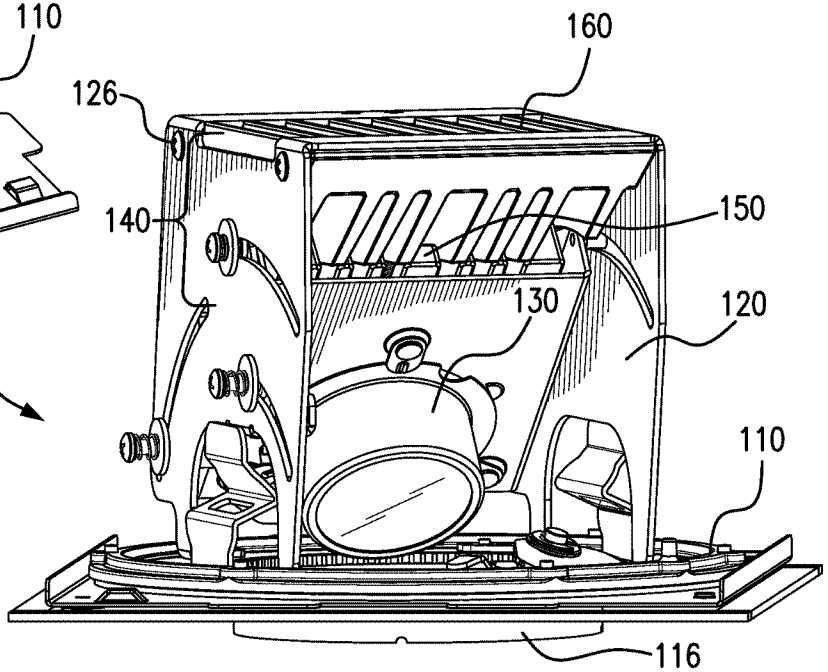
FIGS. 5 and 6 illustrate two different perspective views of the portion of the recessed light fixture of FIG. 1, with the second heat sink shown as transparent to provide a better view of the light source and the first heat sink, which are rotatably adjusted at an angular position of 35 degrees.
Figure 5:
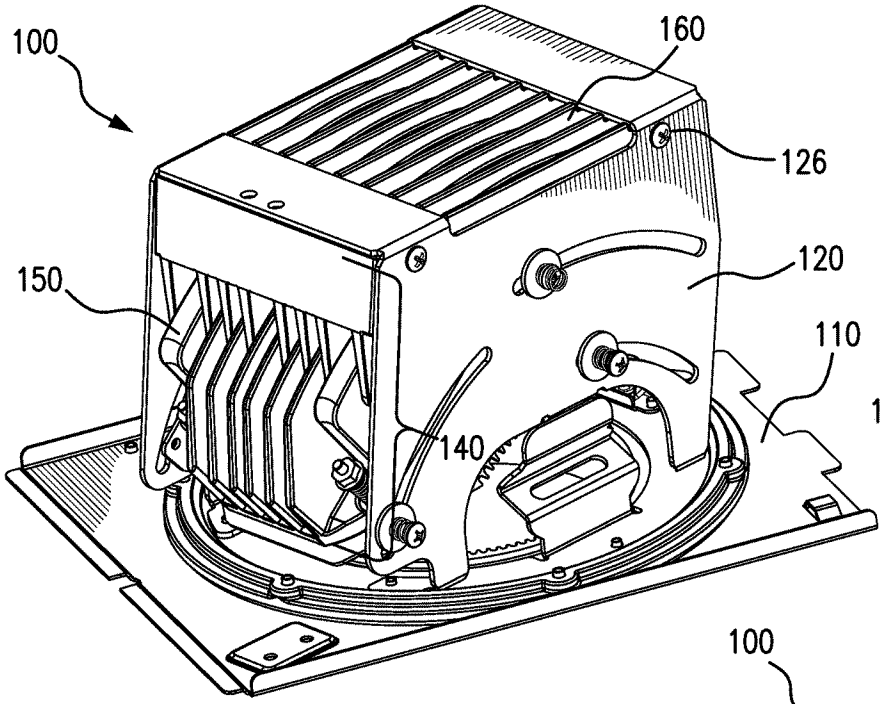
Figure 7:
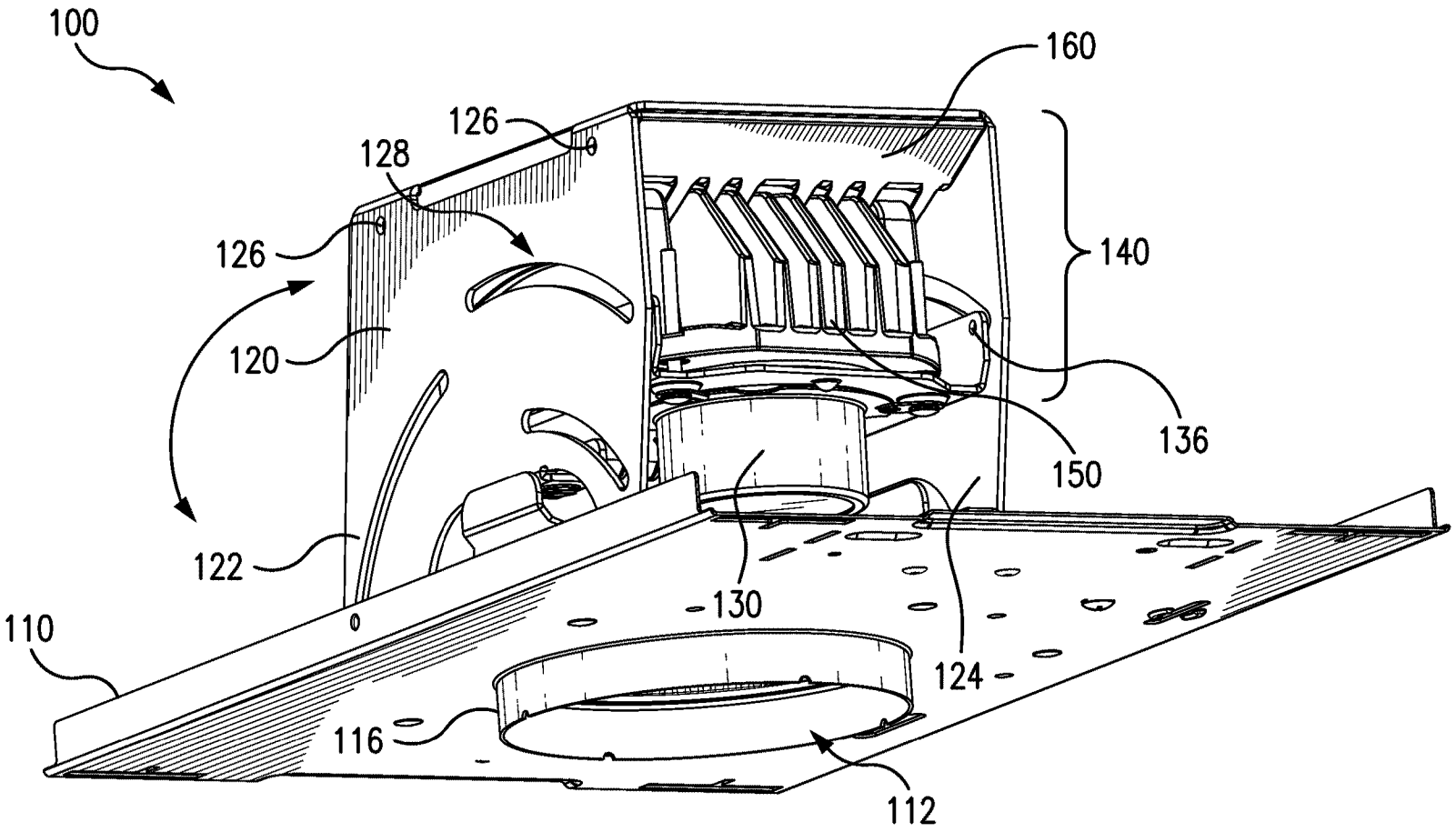
FIG. 7 illustrates another perspective view of the recessed light fixture in FIGS. 5 and 6, with the second heat sink shown as transparent to better view the light source and the first heat sink, which are rotatably adjusted at a vertical position.

Turning to FIGS. 5-7, the recessed light fixture 100 is mountable onto a wall (not shown), such as a ceiling, with the rim 116 around the mounting opening 112 arranged in a ceiling opening (e.g., a cut out in the ceiling). Once mounted, the light source 130 and the first heat sink 150 can be rotatably adjusted to various angular positions. The first heat sink 150 moves in relation to the second heat sink 160, when rotatably adjusting the light source 130 to different angular positions. For example, in FIGS. 5 and 6, the light source 130 and the first heat sink 150 are adjusted at an angular position of 35 degrees. In FIG. 7, the light source 130 and the first heat sink 150 are adjusted at a vertical position. As further shown in FIG. 7, the platform 132 can include bolt hole(s) 136 on opposing sides for movably mounting the platform 132 onto the support frame walls 122 and 124, using bolts which extend through the slots 128 on each of the walls 122 and 124.

Figure 8:
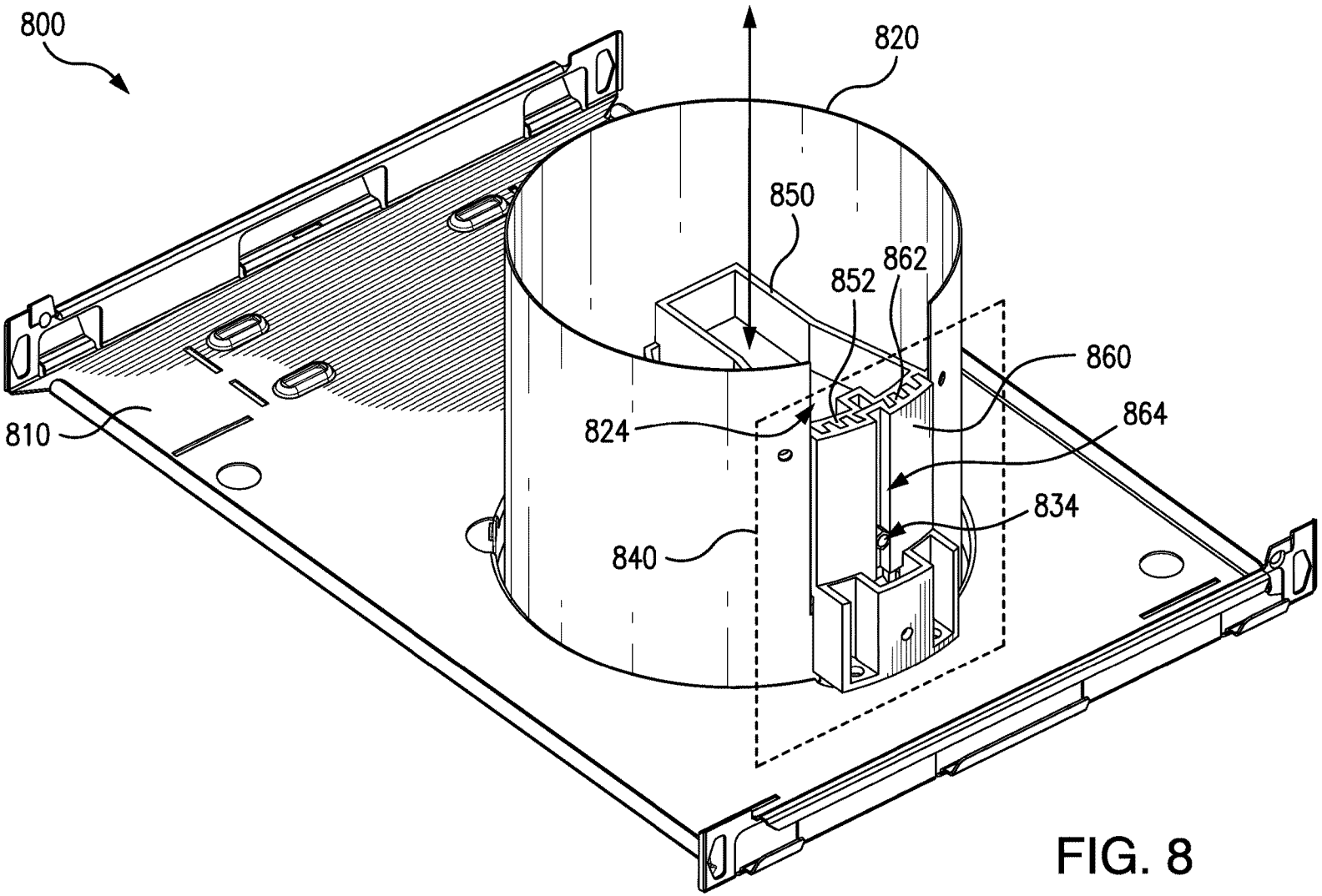
FIG. 8 illustrates a top perspective view of a recessed light fixture with a linearly (e.g., vertically) adjustable light source and dual interlaced heat sinks, such as a vertically movable first heat sink and a stationary heat sink, which are all mounted on a mounting frame, in accordance with an exemplary second embodiment of the present disclosure.
Figure 9:
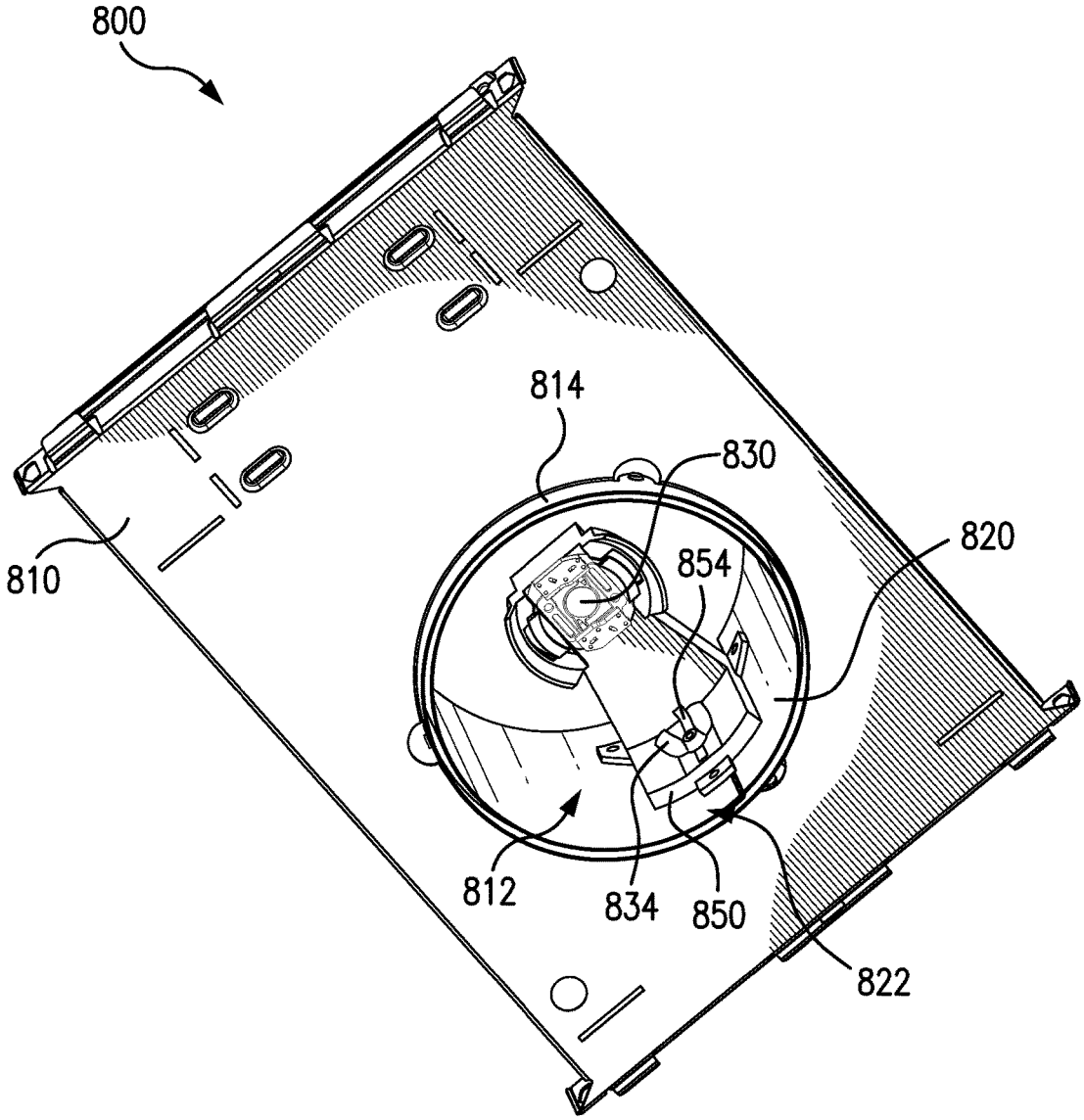
FIG. 9 illustrates a bottom perspective view of the recessed light fixture of FIG. 8.

FIGS. 8 and 9 illustrate a recessed light fixture 800, in accordance with a second embodiment of the present disclosure. The recessed light fixture 800 includes a mounting frame 810, a substantially cylindrical housing 820, a vertically adjustable light source 830 (see e.g., in FIG. 9), and a thermal management system 840 for transferring heat away from the light source 830. The mounting frame 810 includes a mounting opening 812, and a rim 814 around the mounting opening 812. The housing 820 houses the light source 830 therein, and has an open end 822 through which light can be emitted from the light source 830.

The thermal management system 840 includes a movable first heat sink 850 and a second stationary heat sink 860. The first heat sink 850 is connected in the housing 820 and is thermally and physically coupled to the light source 830. The first heat sink 850 supports the light source 830 in the housing 820. The first heat sink 850 includes a plurality of spaced apart first thermally conductive elements 852 that extend through a side opening 824 on a curved portion of the housing 820. In this example, the first thermally conductive elements 852 are fins, which extend vertically along a length of the first heat sink 850 and are substantially parallel to the longitudinal axis of the housing 820. The first heat sink 850 also includes a vertical slot 854 for a fastener 834 (e.g., a bolt and wing nut).

The second heat sink 860 is connected to the mounting frame 810 at a position proximate to the mounting opening 812. The second heat sink 860 includes a plurality of spaced apart second thermally conductive elements 862 that face toward the mounting opening 812, and extend vertically along a length of the second heat sink 860. The first and second thermally conductive elements 852 and 862 are interlaced to allow vertical adjustment of the first heat sink 850 and light source 130 relative to the second heat sink 860. As such, the housing 820 is able to move vertically to accommodate different ceiling heights. For example, the housing 820 can be moved in, through and out of the mounting opening 812 to a desired vertical position.

Once the housing 820 and the light source 830 therein are vertically adjusted to a desired position, the fastener 834 (e.g., a bolt and wing nut), which extends through the vertical slots 854 and 864, can be tightened to secure the first heat sink 850 and the light source 830 at a selected vertical position relative to the second heat sink 860. Through the use of the fastener 834, the first and second heat sinks 850 and 860 can also be forced into contact with each other to further improve heat transfer between the two heat sinks.

Figure 10:
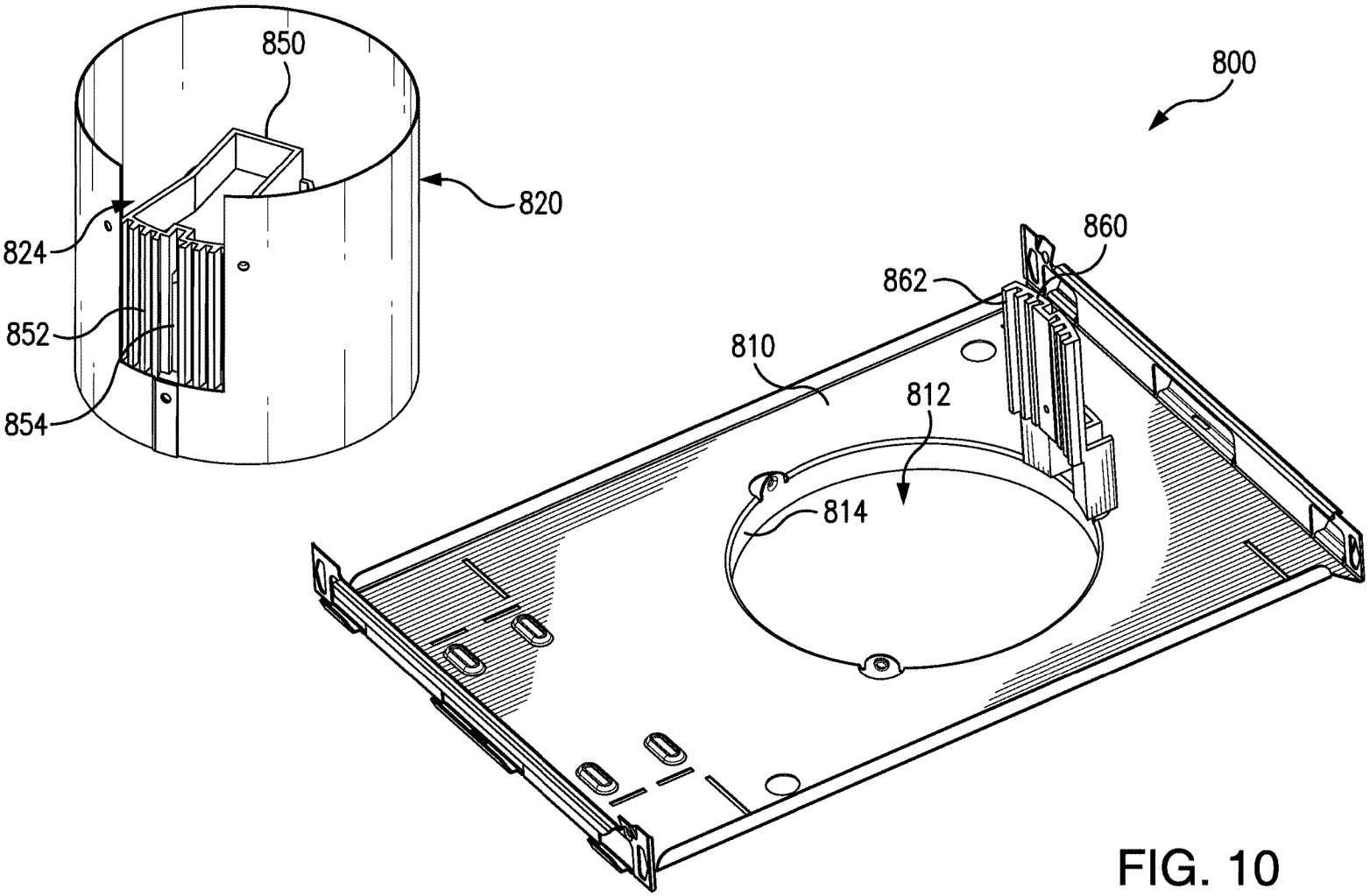
FIG. 10 illustrates a perspective view of the recessed light fixture of FIG. 8, with some of the components separated to provide a better view thereof.

FIG. 10 illustrates another perspective view of the recessed light fixture 800, with the housing 820 and the first heat sink 850 separated from the mounting frame 810 and the second heat sink 860. FIG. 10 provides a better view point of the spaced apart first thermally conductive element 852 of the first heat sink 160, the side opening 824 of the housing 820, and the spaced apart second thermally conductive elements 862.

The recessed light fixtures, as described herein, are simply provided as examples of light fixtures that can incorporate interlaced heat sinks with a movably adjustable light source. The thermally conductive elements of the first and second heat sinks can have any suitable male and female shape, which can be interlaced. For example, instead of fins, the thermally conductive elements of the heat sinks can take the form of pins. In addition, two or more of the thermally conductive elements of the first heat sink or the second heat sink can have substantially the same shape and dimension or different shape and dimension. The thermally conductive elements of the first heat sink or the second heat sink can also be spaced apart with uniform or different spacing therebetween.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. A recessed light fixture comprising:

a movable first heat sink thermally coupled to a movably adjustable light source, the first heat sink being connected to move with the adjustable light source, the first heat sink comprising a plurality of spaced apart first thermally conductive elements; and a second heat sink comprising a plurality of spaced apart second thermally conductive elements interlaced between the first thermally conductive elements to allow heat transfer between adjacent first and second thermally conductive elements; wherein:

the first heat sink is movable along an adjustment direction in relation to the second heat sink;

the first thermally conductive elements form one or more first planar surfaces aligned with the adjustment direction;

the second thermally conductive elements form one or more second planar surfaces aligned with the adjustment direction; and a plurality of the first planar surfaces face corresponding ones of the second planar surfaces, in a parallel face to face relationship along the adjustment direction.

2. The recessed light fixture of claim 1, wherein the first and second thermally conductive elements comprise fins.

3. The recessed light fixture of claim 1, wherein the one or more first planar surfaces of the first heat sink transfer heat to proximate portions of the one or more-second planar surfaces of the second heat sink across an air gap.

4. The recessed light fixture of claim 3, wherein the air gap provides the primary heat transfer medium between the first heat sink and the second heat sink.

5. The recessed light fixture of claim 1, wherein the first heat sink is rotatably adjustable relative to the second heat sink, such that the adjustment direction is an arc.

6. The recessed light fixture of claim 1, wherein the first heat sink is linearly adjustable along with the adjustable light source such that the adjustment direction is a linear translation of the first heat sink relative to the second heat sink.

7. The recessed light fixture of claim 1, wherein two or more of the first thermally conductive elements have substantially the same shape and dimension, and each of the first planar surfaces of the first thermally conductive elements face corresponding ones of the second planar surfaces, in the parallel face to face relationship.

8. The recessed light fixture of claim 1, wherein two or more of the second thermally conductive elements have substantially the same shape and dimension, and each of the second planar surfaces of the second thermally conductive elements face corresponding ones of the first planar surfaces, in the parallel face to face relationship.

9. The recessed light fixture of claim 1, further comprising the adjustable light source.

10. The recessed light fixture of claim 9, further comprising:

a mounting frame, mountable onto a wall, to support the adjustable light source and the first and second heat sinks, the mounting frame having an opening through which light is emitted from the adjustable light source.

11. The recessed light fixture of claim 10, wherein the second heat sink is connected to the mounting frame proximate the opening, the second thermally conductive elements of the second heat sink extending vertically along a length of the second heat sink.

12. The recessed light fixture of claim 11, wherein the first thermally conductive elements extend vertically along a length of the first heat sink, the first heat sink further including a first vertical slot, the second heat sink further including a second vertical slot, the recessed light fixture further including a fastener, extendable through the first and second vertical slots, to secure the first heat sink and adjustable light source at a selected vertical position relative to the second heat sink.

13. The recessed light fixture of claim 12, further comprising: a substantially cylindrical housing connected to the first heat sink and the adjustable light source, the housing having an open end arranged over the opening of the mounting frame.

14. The recessed light fixture of claim 13, wherein the housing includes a side opening through which the first thermally conductive elements of the first heat sink extend and interlace with the second thermally conductive elements of the second heat sink.

15. The recessed light fixture of claim 10, further comprising a support frame to support the first and second heat sinks and the adjustable light source, the support frame being connected to the mounting frame, the first heat sink and the adjustable light source being movably connected to the support frame, the second heat sink being fixedly connected to the support frame.

16. The recessed light fixture of claim 15, wherein the support frame includes a first support frame wall and an opposing second support frame wall, the first and second heat sinks and the adjustable light source being disposed and connected between the first and second support frame walls.

17. The recessed light fixture of claim 15, wherein:

the first heat sink is rotatably adjustable relative to the second heat sink, such that the adjustment direction is an arc that lies perpendicular to an axis of rotation, and the first thermally conductive elements are projections that are perpendicular to the axis of rotation, wherein an end of each projection that is distal to the axis of rotation, is bounded by a first arc shape.

18. The recessed light fixture of claim 17, wherein the second thermally conductive elements are projections integrally formed with a portion of the second heat sink that is fixedly connected to the support frame, the projections being perpendicular to the axis of rotation and projecting from the portion of the second heat sink along a second arc shape, to reduce the size of an air gap between the first arc shape and the second arc shape.

19. The recessed light fixture of claim 17, wherein a center line of the axis of rotation is substantially at the center of the opening.

20. The recessed light fixture of claim 1, wherein each of the first planar surfaces of the first thermally conductive elements defines a depth that is orthogonal to the adjustment direction, and at least one of the planar surfaces of each of the first thermally conductive elements faces the one or more of the planar surfaces of the second thermally conductive elements, in the parallel face to face relationship, along at least fifty percent of the depth.

21. A recessed light fixture comprising:

a movably adjustable light source;

a movable first heat sink thermally coupled to the movably adjustable light source, the first heat sink being connected to move with the movably adjustable light source, the first heat sink comprising a plurality of spaced apart first thermally conductive elements; and a second heat sink comprising a plurality of spaced apart second thermally conductive elements interlaced between the first thermally conductive elements to allow heat transfer between adjacent first and second thermally conductive elements, the first heat sink being movable in relation to the second heat sink;

a mounting frame, mountable onto a wall, to support the adjustable light source and the first and second heat sinks, the mounting frame having an opening through which light is emitted from the movably adjustable light source; and a support frame to support the first and second heat sinks and the movably adjustable light source, the support frame being connected to the mounting frame, the first heat sink and the movably adjustable light source being movably connected to the support frame, the second heat sink being fixedly connected to the support frame;

wherein each of the first and second support frame walls includes a corresponding slot to define a movement range of the first heat sink and the movably adjustable light source in relation to the second heat sink.

* * * * *